US012674220B2

(12) United States Patent
Park et al.

(10) Patent No.: US 12,674,220 B2
(45) Date of Patent: Jul. 7, 2026

(54) HIGH-CARBON STEEL SHEET HAVING GOOD SURFACE QUALITY AND MANUFACTURING METHOD THEREFOR

(71) Applicant: POSCO, Pohang-si (KR)

(72) Inventors: Kyong-Su Park, Pohang-si (KR); Jung-Hyeung Lee, Pohang-si (KR); Deuk-Jung Kim, Pohang-si (KR)

(73) Assignee: POSCO, Pohang-si (KR)

( * ) Notice: Subject to any disclaimer, the term of this patent is extended or adjusted under 35 U.S.C. 154(b) by 931 days.

(21) Appl. No.: 17/798,907

(22) PCT Filed: Feb. 17, 2021

(86) PCT No.: PCT/KR2021/001994
§ 371 (c)(1),
(2) Date: Aug. 11, 2022

(87) PCT Pub. No.: WO2021/167331
PCT Pub. Date: Aug. 26, 2021

(65) Prior Publication Data

US 2023/0090530 A1 Mar. 23, 2023

(30) Foreign Application Priority Data

Feb. 18, 2020 (KR) ..... 10-2020-0019924

(51) Int. Cl.

| | |
|---|---|
| ***C21D 9/46*** | (2006.01) |
| ***C21D 8/0221*** | (2026.01) |
| ***C22C 38/00*** | (2006.01) |
| ***C22C 38/02*** | (2006.01) |
| ***C22C 38/04*** | (2006.01) |
| ***C22C 38/18*** | (2006.01) |
| ***C23G 1/08*** | (2006.01) |

(52) U.S. Cl.
CPC ..... *C21D 9/46* (2013.01); *C21D 8/0226* (2013.01); *C21D 8/0236* (2013.01); *C22C 38/002* (2013.01); *C22C 38/02* (2013.01); *C22C 38/04* (2013.01); *C22C 38/18* (2013.01); *C23G 1/08* (2013.01)

(58) Field of Classification Search
CPC ..... C21D 9/46; C21D 8/0226; C21D 8/0236; C21D 1/02; C21D 3/02; C21D 8/0205; C21D 8/0278; C21D 8/0294; C21D 3/04; C21D 8/0257; C21D 8/0263; C21D 8/0436; C21D 8/0478; C21D 8/1261; C21D 8/1272; C21D 8/02; C22C 38/002; C22C 38/02; C22C 38/04; C22C 38/18; C22C 38/38; C23G 1/08; C23G 3/021
USPC ..... 148/661
See application file for complete search history.

(56) References Cited

U.S. PATENT DOCUMENTS

| | | | | |
|---|---|---|---|---|
| 2017/0067132 | A1* | 3/2017 | Takeda | C22C 38/02 |
| 2017/0369964 | A1 | 12/2017 | Fujii et al. | |
| 2018/0334736 | A1 | 11/2018 | Yamazaki et al. | |
| 2020/0071800 | A1* | 3/2020 | Kim | C22C 38/40 |
| 2021/0147955 | A1 | 5/2021 | Yoo et al. | |

FOREIGN PATENT DOCUMENTS

| | | | |
|---|---|---|---|
| CN | 101837566 | A | 9/2010 |
| CN | 106062231 | A | 10/2016 |
| CN | 107109665 | A | 8/2017 |
| JP | S59-209415 | A | 11/1984 |
| JP | S63-121683 | A | 5/1988 |
| JP | H05-123739 | A | 5/1993 |
| JP | H07-70635 | A | 3/1995 |
| JP | H08-132124 | A | 5/1996 |
| JP | H08-260098 | A | 10/1996 |
| JP | H09-256107 | A | 9/1997 |
| JP | H10-72686 | A | 3/1998 |
| JP | H11-189885 | A | 7/1999 |
| JP | 2004-331994 | A | 11/2004 |
| JP | 2009-197256 | A | 9/2009 |
| JP | 2014-19902 | A | 2/2014 |
| JP | 2016-222990 | A | 12/2016 |
| KR | 10-1996-0017922 | A | 6/1996 |
| KR | 10-2003-0092356 | A | 12/2003 |
| KR | 10-2012-0074135 | A | 7/2012 |

(Continued)

OTHER PUBLICATIONS

International Search Report dated May 7, 2021 issued in International Patent Application No. PCT/KR2021/001994 (with English translation).
Japanese Office Action dated Sep. 26, 2023 issued in Japanese Patent Application No. 2022-549290.
Office Action issued in Chinese application 202180014872.1 dated Mar. 1, 2023 with English Translation.
Search Report issued Jun. 23, 2023 for corresponding European Patent Application No. 21756460.8.

*Primary Examiner* — Danielle M. Carda
(74) *Attorney, Agent, or Firm* — Morgan Lewis & Bockius LLP

(57) ABSTRACT

Provided are a high-carbon steel sheet having good surface quality and a manufacturing method therefor. The present invention provides a high-carbon pickled steel sheet having good surface quality, the steel sheet containing, in weight %, 0.4% or more and less than 1.2% of carbon (C), 0.5% or less (excluding 0%) of silicon (Si), 0.05% or less of phosphorus (P), 0.03% or less of sulfur (S), 0.1 to 2.5% of at least one of manganese (Mn) and chromium (Cr), and the balance of iron (Fe) and inevitable impurities, wherein the average thickness of an internal oxide layer and/or a decarburized layer formed in a surface layer portion of the steel sheet is 1 to 10 μm and the standard deviation of the thickness of the internal oxide layer and/or the decarburized layer in the length direction of the steel sheet is 2 μm or less.

5 Claims, No Drawings

(56) References Cited

FOREIGN PATENT DOCUMENTS

| | | | | | |
|---|---|---|---|---|---|
| KR | 10-2013-0068402 | A | | 6/2013 | |
| KR | 10-2013-0068404 | A | | 6/2013 | |
| KR | 10-2014-0050961 | A | | 4/2014 | |
| KR | 10-2014-0081598 | A | | 7/2014 | |
| KR | 101830551 | B1 | * | 2/2018 | ..... C21D 9/46 |
| KR | 10-2019-0001493 | A | | 1/2019 | |
| KR | 10-2019-0073839 | A | | 6/2019 | |
| KR | 10-2019-0124019 | A | | 11/2019 | |
| KR | 102020387 | B1 | * | 11/2019 | ..... C22C 38/24 |

* cited by examiner

HIGH-CARBON STEEL SHEET HAVING GOOD SURFACE QUALITY AND MANUFACTURING METHOD THEREFOR

CROSS-REFERENCE OF RELATED APPLICATIONS

This application is the U.S. National Phase under 35 U.S.C. § 371 of International Patent Application No. PCT/KR2021/001994, filed on Feb. 17, 2021, which in turn claims the benefit of Korean Application No. 10-2020-0019924, filed on Feb. 18, 2020, the entire disclosures of which applications are incorporated by reference herein.

TECHNICAL FIELD

The present disclosure relates to a high-carbon steel sheet having good surface quality and a manufacturing method therefor, and more particularly, to a high-carbon pickled steel sheet and a high-carbon cold-rolled steel sheet, having good surface quality, and a manufacturing method thereof.

BACKGROUND ART

In the case of high carbon steel, the following Patent Documents, such as suppressing formation of an oxide or a decarburized layer on a surface layer in a manufacturing step to improve surface quality, or using a heat treatment or a special device to remove the generated oxide or decarburized layer on the surface layer, are known.

Patent Document 1 discloses a technique for applying a decarburization inhibitor containing carbon to prevent decarburization occurring during hot working of high-carbon steel, and while this can prevent decarburization in a heating step, it is not preferable to solve a problem of decarburization having occurred during coiling after hot rolling.

Patent Documents 2 and 3 disclose a technique for improving pickling treatment capability by adding an additive containing sulfuric acid as a main component to remove scale generated on a surface of a steel material, but it is different from a technique for uniformly controlling an internal oxide layer, and the like, in a length direction of a coil.

Patent Documents 4 and 5 disclose a technique for removing scale using a heat treatment or induction heating in a decarboxylation reducing atmosphere to effectively remove scale generated on a surface of a steel material, but a cost for manufacturing and using an additional device is high, but it is different from a technique for uniformly controlling an internal oxide layer, and the like, in a length direction of a coil, because there may be costs for manufacturing and using an additional device.

Prior Art Document (Patent Document 1) Japanese Patent Publication No. 1993-123739

(Patent Document 2) Japanese Patent Publication No. 1998-072686

(Patent Document 3) Japanese Patent Publication No. 2004-331994

(Patent Document 4) Japanese Patent Publication No. 1995-070635

(Patent Document 5) Korean Patent Registration No. 10-1428311

SUMMARY OF INVENTION

Technical Problem

An aspect of the present disclosure is to provide a high-carbon steel sheet having good surface quality and a manufacturing method therefor.

The subject of the present invention is not limited to the above. The subject of the present invention will be understood from the overall content of the present specification, and those of ordinary skill in the art to which the present invention pertains will have no difficulty in understanding the additional subject of the present invention.

Solution to Problem

According to an aspect of the present disclosure, a high-carbon pickled steel sheet having good surface quality is provided, the high-carbon pickled steel sheet including, in weight %, 0.4% or more and less than 1.2% of carbon (C), 0.5% or less (excluding 0%) of silicon (Si), 0.05% or less of phosphorus (P), 0.03% or less of sulfur (S), 0.1 to 2.5% of at least one of manganese (Mn) and chromium (Cr), and a balance of iron (Fe) and inevitable impurities, wherein an average thickness of an internal oxide layer and/or a decarburized layer formed in a surface layer portion of the steel sheet is 1 to 10 μm, and a standard deviation of the thickness of the internal oxide layer and/or the decarburized layer in a length direction of the steel sheet is 2 μm or less.

According to another aspect of the present disclosure, a high-carbon cold-rolled steel sheet having good surface quality is provided, the high-carbon cold-rolled steel sheet including, in weight %, 0.4% or more and less than 1.2% of carbon (C), 0.05% or less of phosphorus (P), 0.03% or less of sulfur (S), 0.1 to 2.5% of at least one of manganese (Mn), silicon (Si), and chromium (Cr), and a balance of iron (Fe) and inevitable impurities, wherein an average thickness of an internal oxide layer and/or a decarburized layer formed in a surface layer portion of the steel sheet is 1×[1−cold reduction (%)] μm to 10×[1−cold reduction (%)], and a standard deviation of the thickness of the internal oxide layer and/or the decarburized layer in a length direction of the steel sheet is 2 μm or less.

According to another aspect of the present disclosure, a manufacturing method for a high-carbon pickled steel sheet having good surface quality is provided, the manufacturing method, including operations of: preparing a hot-rolled coil; and removing an internal oxide layer and/or a decarburized layer in a surface layer portion by immersing the hot-rolled coil in a pickling tank and passing the same therethrough, wherein, when the hot-rolled coil is divided into a first region, a second region, a third region, a fourth region, and a fifth region, in a length direction, a pickling tank passing speed of a hot-rolled coil corresponding to the second region, the third region, and the fourth region is controlled to be slower than a pickling tank passing speed of a hot-rolled coil corresponding to the first region and the fifth region.

According to another aspect of the present disclosure, a manufacturing method for a high-carbon cold-rolled steel sheet having good surface quality is provided, the manufacturing method including operations of: preparing a hot-rolled coil; removing an internal oxide layer and/or a decarburized layer in a surface layer portion by immersing the hot-rolled coil in a pickling tank and passing the same therethrough; and cold rolling a hot-rolled steel sheet from which the internal oxide layer and/or the decarburized layer has been removed, wherein, when the hot-rolled coil is divided into a first region, a second region, a third region, a fourth region, and a fifth region, in a length direction, a pickling tank passing speed of a hot-rolled coil corresponding to the second region, the third region, and the fourth region is controlled to be slower than a pickling tank passing speed of a hot-rolled coil corresponding to the first region and the fifth region.

Advantageous Effects of Invention

In the present disclosure having the configuration as described above, it is possible to provide a high-carbon steel sheet having good surface quality in which internal oxide layers are uniformly formed in a length direction of the steel sheet, and a manufacturing method therefor. In particular, the present disclosure does not incur additional costs through additional processes, equipment, or the like, but rather improves productivity of pickling compared to the existing methods, thereby reducing manufacturing costs.

BEST MODE FOR INVENTION

Hereinafter, the present disclosure will be described.

In general, as is well known, in a surface layer portion of a hot-rolled coil manufactured through conventional reheating, finishing rolling, cooling, and coiling, there is an internal defect layer such as an internal oxide layer and/or a decarburized layer. The internal oxide layer may occur in a process in which oxidation of components such as chromium (Cr), manganese (Mn), silicon (Si), zinc (Zn), magnesium (Mg), and aluminum (Al), which have higher oxygen affinity, than iron (Fe), occurs in a base material. The decarburized layer may occur in a process of being discharged to an atmosphere in a form of a gas after carbon in steel is combined with oxygen in scale along with the atmosphere, and a thickness of the internal defect layer may vary depending on a composition of a hot-rolled steel sheet, a temperature when a hot-rolled steel sheet is coiled with a hot-rolled coil (HC), a cooling time after coiling, a width, a thickness, a length, and the like, of the hot-rolled steel sheet, and may be within 50 μm.

Meanwhile, the internal defect layer also affects a subsequent pickling process and a cold-rolling process, thereby ultimately becoming a factor to deteriorate surface properties of the finally manufactured steel sheet. In particular, in the case of high carbon steel containing 0.4% C or more, a time required to complete microstructure transformation due to cooling in a ROT after finishing rolling becomes longer, and accordingly, a temperature of the hot-rolled coil wound increases by transformation heating, so that there may be a significant deviation in the thickness of the internal defect layer such as the internal oxide layer and/or the decarburized layer between front and rear end portions and a middle end portion of the hot-rolled coil. Accordingly, in the present disclosure, by providing optimum pickling conditions, using a hot-rolled coil exhibiting thickness deviations such as of the internal oxide layer, or the like, a high-carbon pickled steel sheet and a cold-rolled steel sheet having good surface quality may be provided.

Hereinafter, a pickled steel sheet and a cold-rolled steel sheet of the present disclosure will be described.

First, the pickled steel sheet and the cold-rolled steel sheet of the present disclosure are not limited to a specific steel composition component, and carbon steel having various composition components may be used. Preferably, high carbon steel having 0.4% or more of C is used.

More preferably, a steel sheet is used, the steel sheet including, in weight %, 0.4% or more and less than 1.2% of carbon (C), 0.5% or less (excluding 0%) of silicon (Si), 0.05% or less of phosphorus (P), 0.03% or less of sulfur (S), 0.1 to 2.5% of at least one of manganese (Mn) and chromium (Cr), and a balance of iron (Fe) and inevitable impurities. Hereinafter, the steel composition component of the present disclosure and the reason for limiting a content thereof will be described. Meanwhile, "%" as used herein means "%" by weight, unless otherwise specified.

Carbon (C): 0.4% or More and Less Than 1.2%

Carbon (C) is an element that effectively contributes to improving strength of steel, so that, in the present disclosure, a certain level or more of carbon (C) may be included in order to secure strength of a high carbon steel sheet. In addition, when a content of C is lower than a certain level, desired strength, hardness, and durability of a final part cannot be ensured and a function of the high carbon steel sheet cannot be obtained, so in the present disclosure, a lower limit of the content of carbon (C) may be limited to 0.4%. On the other hand, when carbon (C) is excessively added, the strength is improved, but cracks may occur during a manufacturing process thereof or cracks also occur on a surface thereof due to formation of excessive proeutectoid cementite, which may cause a problem of deterioration of surface quality. Therefore, in the present disclosure, the content of carbon (C) may be limited to less than 1.2%. Accordingly, in the present disclosure, the content of carbon (C) may be in a range of 0.4% or more and less than 1.2%.

Silicon (Si): 0.5% or Less (Excluding 0%)

Silicon (Si) is an element having a strong affinity with oxygen, so when a Large amount of Si is added, it is not preferable because it may cause surface defects observed with the naked eye such as surface scale, including red scale. Accordingly, in the present disclosure, an upper limit of a content of silicon (Si) may be limited to 0.5%. However, since silicon (Si) is an element not only acting as a deoxidizer but also contributing to improving strength of steel, in the present disclosure, 0% may be excluded from a lower limit of the content of silicon (Si).

Phosphorus (P): 0.05% or Less

Phosphorus (P) is a major element segregating at grain boundaries and may cause a deterioration in toughness of steel. Therefore, it is preferable to control a content of phosphorus (P) as low as possible. Therefore, it is theoretically most advantageous to limit the content of phosphorus (P) to 0%. However, since phosphorus (P) is an impurity that is unavoidably introduced into steel during a steelmaking process, and an excessive process load may be caused to control the content of phosphorus (P) to 0%. Accordingly, in the present disclosure, in consideration of this point, an upper limit of the content of phosphorus (P) may be limited to 0.05%.

Sulfur (S): 0.03% or Less

Sulfur (S) is a major element forming Mns, increasing an amount of precipitates, and embrittling steel. Therefore, it is preferable to control a content of sulfur (S) as low as possible. Therefore, it is theoretically most advantageous to limit the content of sulfur (S) to 0%. However, sulfur (S) is also an impurity that is unavoidably introduced into steel during a steelmaking process, and an excessive process load may be caused to control the content of sulfur (S) to 0%. Accordingly, in the present disclosure, in consideration of this point, an upper limit of the content of sulfur (S) may be limited to 0.03%.

At Least One of Manganese (Mn) and Chromium (Cr): 0.1% or More and Less than 2.5%

Manganese (Mn) and chromium (Cr) are elements contributing to forming hardenability of steel, so in the present disclosure, manganese (Mn) and chromium (Cr) may be included to achieve this effect. However, excessive addition of manganese (Mn) and chromium (Cr), which are relatively expensive elements, is not preferable from an economic point of view, and if excessive amounts of manganese (Mn) and chromium (Cr) are added, weldability may be deteriorated. Therefore, in the present disclosure, a content of at least one of manganese (Mn) and chromium (Cr) may be in a range of 0.1% or more and less than 2.5%.

In the present disclosure, in addition to the steel composition described above, a remainder may include Fe and inevitable impurities. Inevitable impurities may be inevitably added in a typical steel manufacturing process, and it cannot be completely excluded, and those skilled in the ordinary steel manufacturing field can easily understand the meaning. In addition, in the present disclosure, the addition of a composition, other than the steel composition described above, should not be not entirely excluded.

In the pickled steel sheet of the present disclosure, an average thickness of an internal oxide layer and/or a decarburized layer formed in a surface layer portion of a steel sheet is required to be in a range of 1 to 10 μm. If the thickness is less than 1 μm, the internal oxide layer and/or the decarburized layer are removed in large amounts or the internal oxide layer and/or the decarburized layer are entirely removed so that an uncontrollable level thereof is present. In this case, there is a problem in that pickling productivity is deteriorated as well as consumption of the steel sheet removed due to pickling increases. Meanwhile, if the thickness thereof exceeds 10 μm, the internal oxide layer and/or the decarburized layer remaining on the surface thereof are left thick, so that there may be a problem of deteriorating surface quality such as durability, or the like.

Meanwhile, in the present disclosure, the thickness of the internal oxide layer and/or the decarburized layer is obtained by measuring a cross-section of the steel sheet with an optical microscope or an scanning electron microscope (SEM), and the average thickness is obtained by measuring at least five locations in the length direction of the steel sheet, to obtain an average value thereof. That is, in the present disclosure, the thickness of the internal oxide layer and/or the decarburized layer is obtained by measuring a cross-section of the steel sheet with an optical microscope or scanning electron microscope (SEM), and the decarburized layer is divided into a base material layer and a decarburized layer by measuring a cross-section corroded using a corrosion solution such as nital, or the like, and the internal oxide layer is divided into a base material layer and an internal oxide layer by being directly observed from the cross-section thereof without corrosion. In this case, the average thickness of the internal oxide layer and/or the decarburized layer is obtained by measuring at least five locations the length direction of the steel sheet, to obtain an average value thereof. A measurement position in the length direction of the steel sheet is measured by taking one or more samples from each region, when a coil is equally divided into 5 equal regions in the length direction. In addition, the standard deviation is obtained by calculating a standard deviation value for data in at least five locations in the length direction of the steel sheet measured thereabove.

Meanwhile, in the cold-rolled steel sheet of the present disclosure, the average thickness of the internal oxide layer and/or the decarburized layer formed in the surface layer portion of the steel sheet satisfies a range of 1×[1−cold reduction (%)] μm to 10×[1−cold reduction (%)] μm. That is, the thickness of the internal oxide layer and/or the decarburized layer formed in the surface layer portion of the steel sheet is also reduced according to a reduction during cold rolling. Preferably, the average thickness of the internal oxide layer and/or the decarburized layer formed in the surface layer portion of the cold-rolled steel sheet is managed in a range of 0.2 to 8 μm.

In addition, in the pickled steel sheet and cold-rolled steel sheet of the present disclosure, the standard deviation of the thickness of the internal oxide layer and/or the decarburized layer in the length direction of the steel sheet satisfies 2 μm or less. If the standard deviation of the thickness thereof exceeds 2 μm, a deviation in surface quality occurs for each location, and a deviation in an amount removed through pickling occurs, so that there may be a problem in that an amount of consumption of the steel sheet removed through pickling is increased or is not sufficiently removed, resulting in lowering surface quality. More preferably, the standard deviation of the thickness thereof is limited to 1.6 μm or less.

Next, a manufacturing method for a pickled steel sheet and a cold-rolled steel sheet having good surface quality according to the present disclosure will be described.

First, in the present disclosure, a hot-rolled coil is prepared.

First, as described above, the present disclosure is not limited to the steel composition component of the hot-rolled coil. Preferably, it is high-carbon steel having 0.4% or more of C, and more preferably, a steel sheet including, in wt %, 0.4% or more and less than 1.2% of carbon (C), 0.5% or less (excluding 0%) of silicon (Si), 0.05% or less of phosphorus (P), 0.03% or less of sulfur (S), 0.1 to 2.5% of at least one of manganese (Mn) and chromium (Cr), and a balance of iron (Fe) and inevitable impurities, is used.

In addition, the present disclosure is not limited to a specific manufacturing process for manufacturing the hot-rolled coil, and a general manufacturing process may be used. Specifically, the general manufacturing process of the hot-rolled coil includes operations of: reheating a steel slab provided with the above-described steel composition; providing a hot-rolled steel sheet by hot rolling the reheated slab; cooling the hot-rolled hot-rolled steel sheet; coiling the cooled hot-rolled steel sheet; and cooling the coiled coil.

As an example, a hot-rolled coil may be manufactured using the following manufacturing processes.

Reheating and Hot Rolling a Slab

A slab manufactured by the conventional slab manufacturing process may be reheated in a certain temperature range. For a sufficient homogenization treatment, a lower limit of a reheating temperature may be limited to 1050° C., and an upper limit of the reheating temperature may be limited to 1350° C. in consideration of economic feasibility and surface quality.

Then, the reheated slab may be rough-rolled by a conventional method, and the rough-rolled steel slab may be hot rolled to a thickness of 1.5 mm to 10 mm by finishing hot-rolling. In the present disclosure, hot rolling may be performed under conventional conditions, but a finishing rolling temperature for controlling a rolling load and reducing a surface scale may be in a range of 800 to 950° C.

Cooling and Coiling

Control cooling may be performed on a hot-rolled steel sheet immediately after hot rolling.

In the present disclosure, since surface quality of the hot-rolled steel sheet is strictly controlled, it is preferable that cooling in the present disclosure is started within 5 seconds. When a time from hot rolling to a start of cooling exceeds 5 seconds, an internal oxide layer and/or a decarburized layer, not intended by the present disclosure, may be formed in a surface layer portion of the steel sheet, by air cooling in an atmosphere. A more preferable time from hot rolling to the start of cooling may be within 3 seconds.

In addition, the hot-rolled steel sheet immediately after hot rolling may be cooled to a coiling temperature of 500° C. or more and 750° C. or less at a cooling rate of 10 to 1000° C./s. When the cooling rate is less than 10° C./s, an internal oxide layer and/or a decarburized layer may be formed in a surface layer portion of the steel sheet during cooling, so there may be a problem in that surface quality desired by the present disclosure cannot be secured. Although, in the present disclosure, an upper limit of the cooling rate is not specifically limited to secure the desired surface quality, the upper limit of the cooling rate may be limited to 1000° C./s in consideration of facility limitations and economic feasibility. In addition, when the coiling temperature is less than 500° C., a low-temperature transformation structure such as bainite or martensite may be formed to cause cracks in the steel sheet. When the coiling temperature exceeds 750° C., an excessively large amount of the internal oxide layer and/or the decarburized layer may be formed in the surface layer portion of the steel sheet, so that there may be a problem in that the surface quality desired by the present disclosure cannot be secured.

Cooling the Coiled Coil

The coiled coil is air cooled. In this case, in a high-carbon hot-rolled steel sheet, an oxide and/or a decarburized layer may be additionally formed directly below a surface thereof as well as a scale layer formed on a surface layer. The oxide and/or the decarburized layer formed directly below the surface layer are formed to have different depths in front and rear end portions and in a central portion in a length direction of the hot-rolled steel sheet. This is because temperatures in the front and rear end portions and in the central portion may be different, when the hot-roiled coil is cooled in a coiled state. The oxide and decarburized layers, directly below the surface in the front and rear end portions and in the central portion may have a depth of 0 to 5 μm and 3 to 20 μm, respectively.

In the hot-rolled steel sheet prepared by the above manufacturing method, the internal oxide layer and/or the decarburized layer formed in the surface layer portion may be formed to have an average thickness of 2 to 20 μm.

In the present disclosure, the internal oxide layer and/or the decarburized layer of the surface layer are removed by immersing the hot-rolled coil in a pickling solution of the pickling tank and passing the same therethrough.

In this case, in the present disclosure, when the hot-rolled coil is divided into a first region, a second region, a third region, a fourth region, and a fifth region, in a length direction, a pickling tank passing speed of a hot-rolled coil corresponding to the second region, the third region, and the fourth region is controlled to be slower than a pickling tank passing speed of a hot-rolled coil corresponding to the first region and the fifth region. In addition, it is preferable to control the pickling tank passing speed of the hot-rolled coil corresponding to the third region be slower than the pickling tank passing speed of the hot-rolled coil corresponding to the second and fourth regions. Thereby, it is possible to obtain a pickled steel sheet having a reduced thickness deviation in the length direction through pickling treatment despite the thickness deviation by length of the internal oxide layer and/or the decarburized layer formed on the hot-rolled coil. In the present disclosure, the thickness of the internal oxide layer and/or the decarburized layer in the third region is the thickest, and the division may be equal division.

More preferably, the pickling tank passing speed of the hot-rolled coil in the third region is 5 mpm to 50 mpm, an average pickling tank passing speed thereof in the first region and the fifth region is controlled to be 5×[pickling tank passing speed of the hot-rolled coil in the third region]×½ to 5×[pickling tank passing speed of the hot-rolled coil in the third region]×2, and a pickling tank passing speed of the hot-rolled coil in the second region and the fourth region is controlled to be 5×[pickling tank passing speed of the hot-rolled coil in the third region/2]×½ to 5×[pickling tank passing speed of the hot-rolled coil in the third region/2]×2.

The pickling tank passing speed of the hot-rolled coil in the third region needs to be maintained at 50 mpm or less in order to effectively remove the oxide and the decarburized layer directly below the surface. Meanwhile, if the passing speed thereof is too low, an amount of steel sheet removed through pickling increases due to over-pickling, and a pickling rate is slow and productivity is deteriorated, so that it preferable that the speed is controlled to be 5 mpm or more.

The pickling tank passing speed of the hot-rolled coil in the first region and fifth region may be controlled to be faster than that in the third region, and the speed thereof should be controlled to be 5×[pickling tank passing speed of the hot-rolled coil in the third region]×½ to 5×[pickling tank passing speed of the hot-rolled coil in the third region]×2, based on the pickling tank passing speed of the hot-rolled coil in the third region. It is preferable to be controlled to a range in which the oxide and the decarburized layer directly below the surface is effectively removed and productivity is not reduced.

The pickling tank passing speed of the hot-rolled coil in the second region and fourth region may be controlled to be faster than that in the third region, and the speed thereof should be controlled to be 5×[pickling tank passing speed of the hot-rolled coil in the third region/2]×½ to 5×[pickling tank passing speed of the hot-rolled coil in the third region/2]×2, based on the pickling tank passing speed of the hot-rolled coil in the third region. It is preferable to be controlled to a range in which the oxide and the decarburized layer directly below the surface is effectively removed and productivity is not reduced.

In addition, in the present disclosure, when the hot-rolled coil is divided into n regions in the length direction, it is more preferable that a pickling tank passing speed of a hot-rolled coil, corresponding to a $(n/2)^{th}$ region, the region in which the thickness of the internal oxide layer and/or the decarburized layer is the thickest, is 5 mpm to 50 mpm, in the case of $t \leq (n/2)$, a pickling tank passing speed of a hot-rolled coil corresponding to each region is controlled by the following Relational Expression 1, and in the case of $t > (n/2)$, the pickling tank passing speed of the hot-rolled coil corresponding to each region is controlled by the following Relational Expression 2.

[Relational Expression 1]

A pickling tank passing speed of the hot-rolled coil corresponding to a $t^{th}$ region=n×[pickling tank passing speed of the hot-rolled coil corresponding to the $(n/2)^{th}$ region/t]×½ to n×[pickling tank passing speed of the hot-rolled coil corresponding to the $(n/2)^{th}$ region/t]×2

[Relational Expression 2]

A pickling tank passing speed of the hot-rolled coil corresponding to the $t^{th}$ region=n×[pickling tank passing speed of the hot-rolled coil corresponding to the $(n/2)^{th}$ region/(n−t+1)]×½ to n×[pickling tank passing speed of the hot-rolled coil corresponding to the $(n/2)^{th}$ region/(n−t+1)]×2 where, in Relational Expressions 1 to 2, n is a natural number, and the $t^{th}$ refers to an order sequentially assigned to correspond to each region divided in the length direction of the hot-rolled coil.

Meanwhile, in a pickling process of the present disclosure, an internal oxide layer and/or a decarburized layer formed in a surface layer portion may be efficiently removed by controlling a concentration of acid and a temperature of a pickling solution in a pickling tank as well as the pickling rate described above.

Specifically, a concentration of hydrochloric acid in the pickling solution may be 5 to 25%. When the concentration of hydrochloric acid is less than 5%, there may be a problem that a pickling capability is lowered, and when the concentration of hydrochloric acid exceeds 25%, there may be a problem in that the concentration of hydrochloric acid is high, resulting in overpickling or increased costs.

The temperature of the pickling solution may be 70° C. to 90° C. When a temperature of acid is less than 70° C., there may be a problem in that the pickling ability is lowered, and when the temperature of acid is 90° C. or more, there may be a problem of overpickling or increased consumption due to evaporation.

Through the pickling treatment as described above, a high-carbon pickled steel sheet having good surface quality may be provided. In the high-carbon pickled steel sheet, an average thickness of an internal oxide layer and/or a decarburized layer formed in a surface layer portion thereof is 1 to 10 μm, a standard deviation of the thickness of the internal oxide layer and/or the decarburized layer in a length direction is 2 μm or less, and more preferably, the standard deviation of the thickness thereof is 1.6 μm or less.

Subsequently, in the present disclosure, a cold-rolled steel sheet may be manufactured by cold rolling the pickled steel sheet.

A reduction of the cold rolling may be 10% to 80% depending on the strength and thickness requirements of a final product. When cold rolling is performed as described above, an average thickness of the oxide layer and the decarburized layer directly below a surface of the pickled steel sheet decreases in proportion to the reduction. That the thickness of the internal oxide layer and the decarburized layer of the cold-rolled steel sheet may be [thickness of the internal oxide layer and the decarburized layer of the pickled steel sheet]×cold reduction (%)/100.

Therefore, in the cold-rolled steel sheet of the present disclosure, the average thickness of the internal oxide layer and/or the decarburized layer formed in the surface layer portion of the steel sheet may satisfy 1×[1−cold reduction (%)] μm to 10×[1−cold reduction (%))] μm.

Preferably, the average thickness of the internal oxide layer and/or the decarburized layer formed in the surface layer portion of the cold-rolled steel sheet satisfies a range of 0.2 to 8 μm.

Meanwhile, the standard deviation of the thickness of the internal oxide layer and/or the decarburized layer in the length direction of the cold-rolled steel sheet may be maintained at 2 μm or less, more preferably 1.6 μm or less, as in the case of the above-described pickled steel sheet.

Mode for Invention

Hereinafter, the present disclosure will be described in detail through Examples. The present disclosure will be described in more detail through examples. However, it should be noted that the following examples are for illustrative purposes only and are not intended to limit the scope of the present disclosure. The scope of the present disclosure may be determined by matters described in the claims and matters able to be reasonably inferred therefrom.

Example

After manufacturing a hot-rolled coil having the composition shown in Table 1 below, a pickled steel sheet and a cold-rolled steel sheet were manufactured using the conditions shown in Table 2 below. Each hot-rolled coil was manufactured using a conventional manufacturing method. That is, a steel slab having the composition shown in Table 1 below was reheated in a temperature range of 1050 to 1350° C. and then rough rolled, and then, the rough-rolled steel slab was finishing hot rolled in a temperature range of 800 to 950° C. Thereafter, the finishing hot-rolled steel sheet was cooled to a temperature range of 500 to 750° C. at a cooling rate of 10 to 1000° C./s, then coiled, and then, the coiled hot-rolled coil was air-cooled.

Each of the prepared hot-rolled coils was immersed in a pickling tank under the conditions in Table 2 below to be pickled, so that an internal oxide layer and/or a decarburized layer formed on a surface thereof was removed to manufacture a pickled steel sheet. Specifically, when each of the prepared hot-rolled coils is divided into 5 equal parts in a length direction into a first region, a second region, a third region, a fourth region, and a fifth region, a speed at which the hot-rolled coil for each region passes through a pickling tank was controlled as shown in Table 2 below to prepare a picked steel sheet.

Thereafter, an average thickness (μm) of an internal oxide layer and/or a decarburized layer of a pickled steel sheet from which the internal oxide layer and/or the decarburized layer on a surface thereof have been removed after being discharged from the pickling tank was measured with respect to an average thickness (μm) of an internal oxide layer and/or a decarburized layer of a hot-rolled coil before pickling and the results thereof were shown in Table 3 below. In this case, a standard deviation (μm) of the thickness of the internal oxide layer and/or the decarburized layer in the length direction of the pickled steel sheet was also measured and shown in Table 3 below.

Meanwhile, in the present disclosure, a cold-rolled steel sheet was also manufactured by cold-rolling the manufactured pickled steel sheet under the conditions shown in Table 2 below. The average thickness (μm) of the internal oxide layer and/or the decarburized layer of each of the manufactured cold-rolled steel sheets was measured with respect to an average thickness (μm) of the internal oxide layer and/or the decarburized layer of the hot-rolled coil before pickling, and the results thereof were shown in Table 3 below. In this case, a standard deviation (μm) of the thickness of the internal oxide layer and/or the decarburized layer in the length direction of the cold-rolled steel sheet was also measured and shown in Table 3 below.

Here, a specific method for measuring the average thickness (μm) and standard deviation (μm) of the internal oxide layer and/or the decarburized layer is as follows. First, the thickness of the internal oxide layer and/or the decarburized layer is obtained by measuring a cross-section of a steel sheet with an optical microscope or scanning electron microscope (SEM), and the decarburized layer is divided into a base material layer and a decarburized layer by measuring a cross-section corroded using a corrosion solution such as nital, or the like, and the internal oxide layer is divided into a base material layer and an internal oxide layer by being directly observed from the cross-section thereof without corrosion. In this case, the average thickness of the internal oxide layer and/or the decarburized layer is obtained by measuring at least five locations in the length direction of the steel sheet and an average value thereof is calculated, and a measurement position of the steel sheet in the length direction is measured by taking one or more samples in each region, when the coil is equally divided into 5 equal regions in the length direction. In addition, the standard deviation is obtained by calculating a standard deviation value for data in at least five locations in the length direction of the steel sheet measured thereabove.

TABLE 1

| Steel | Composition component of hot-rolled coil (weight %) | | | | | | |
|---|---|---|---|---|---|---|---|
| type | C | Si | P | S | Mn | Cr | Balance |
| 1 | 0.46 | 0.07 | 0.012 | 0.003 | 0.41 | 0.40 | Fe and impurities |
| 2 | 0.74 | 0.06 | 0.010 | 0.004 | 0.40 | 0.25 | |
| 3 | 0.85 | 0.08 | 0.014 | 0.003 | 0.40 | 0.45 | |
| 4 | 1.05 | 0.06 | 0.012 | 0.004 | 0.43 | 0.09 | |
| 5 | 1.25 | 0.07 | 0.015 | 0.003 | 0.40 | 0.23 | |
| 6 | 0.85 | 0.55 | 0.011 | 0.003 | 0.40 | 0.25 | |

TABLE 2

| Steel type | Pickling tank passing speed in a first region (mpm) | Pickling tank passing speed in a second region (mpm) | Pickling tank passing speed in a third region (mpm) | Pickling tank passing speed in a fourth region (mpm) | Pickling tank passing speed in a fifth region (mpm) | Concentration of hydrochloric acid (%) | Temperature of pickling solution (° C.) | Cold reduction (%) | Reference |
|---|---|---|---|---|---|---|---|---|---|
| 1 | 60 | 40 | 20 | 40 | 60 | 15 | 80 | 50 | Inventive Example 1 |
| 2 | 30 | 20 | 10 | 20 | 30 | 15 | 80 | 50 | Inventive Example 2 |
| 2 | 50 | 25 | 10 | 25 | 50 | 15 | 80 | 50 | Inventive Example 3 |
| 2 | 70 | 40 | 10 | 40 | 70 | 15 | 80 | 50 | Inventive Example 4 |
| 2 | 50 | 40 | 20 | 40 | 50 | 15 | 80 | 50 | Inventive Example 5 |
| 2 | 50 | 25 | 10 | 25 | 50 | 20 | 80 | 50 | Inventive Example 6 |
| 2 | 50 | 25 | 10 | 25 | 50 | 15 | 85 | 50 | Inventive Example 7 |
| 2 | 50 | 25 | 10 | 25 | 50 | 15 | 80 | 20 | Inventive Example 8 |
| 2 | 50 | 25 | 10 | 25 | 50 | 15 | 80 | 70 | Inventive Example 9 |
| 3 | 50 | 25 | 10 | 25 | 50 | 15 | 80 | 50 | Inventive Example 10 |
| 4 | 50 | 25 | 10 | 25 | 50 | 15 | 80 | 50 | Inventive Example 11 |
| 2 | 10 | 10 | 10 | 10 | 10 | 15 | 80 | 50 | Comparative Example 1 |
| 2 | 50 | 50 | 50 | 50 | 50 | 15 | 80 | 50 | Comparative Example 2 |
| 5 | 50 | 25 | 10 | 25 | 50 | 15 | 80 | 50 | Comparative Example 3 |
| 6 | 50 | 25 | 10 | 25 | 50 | 15 | 80 | 50 | Comparative Example 4 |
| 2 | 5 | 5 | 5 | 5 | 5 | 15 | 80 | 50 | Conventional Example |

TABLE 3

| Steel type | Average thickness of internal oxide layer/decarburized layer of hot-rolled steel sheet (μm) | Average thickness of internal oxide layer/decarburized layer of pickled steel sheet (μm) | Standard deviation of thickness of internal oxide layer/decarburized layer in a length direction of pickled steel sheet (μm) | Average thickness of internal oxide layer/decarburized layer of cold-rolled steel sheet (μm) | Standard deviation of thickness of internal oxide layer/decarburized layer in a length direction of cold-rolled steel (μm) | Reference |
|---|---|---|---|---|---|---|
| 1 | 6.7 | 4.3 | 0.8 | 1.9 | 0.5 | Inventive Example 1 |

TABLE 3-continued

| Steel type | Average thickness of internal oxide layer/decarburized layer of hot-rolled steel sheet (μm) | Average thickness of internal oxide layer/decarburized layer of pickled steel sheet (μm) | Standard deviation of thickness of internal oxide layer/decarburized layer in a length direction of pickled steel sheet (μm) | Average thickness of internal oxide layer/decarburized layer of cold-rolled steel sheet (μm) | Standard deviation of thickness of internal oxide layer/decarburized layer in a length direction of cold-rolled steel (μm) | Reference |
|---|---|---|---|---|---|---|
| 2 | 12.1 | 6.3 | 1.2 | 3.1 | 0.7 | Inventive Example 2 |
| 2 | 11.8 | 7.1 | 1.4 | 3.4 | 0.8 | Inventive Example 3 |
| 2 | 12.2 | 8.4 | 1.5 | 3.9 | 1.0 | Inventive Example 4 |
| 2 | 12.2 | 8.2 | 1.2 | 4.1 | 0.6 | Inventive Example 5 |
| 2 | 12.0 | 6.2 | 1.3 | 3.3 | 0.6 | Inventive Example 6 |
| 2 | 10.4 | 6.4 | 1.3 | 3.5 | 0.7 | Inventive Example 7 |
| 2 | 12.9 | 7.5 | 1.3 | 5.1 | 1.1 | Inventive Example 8 |
| 2 | 11.6 | 6.8 | 1.2 | 2.1 | 0.3 | Inventive Example 9 |
| 3 | 14.1 | 8.4 | 1.6 | 4.6 | 1.0 | Inventive Example 10 |
| 4 | 16.4 | 9.1 | 1.5 | 5.2 | 0.9 | Inventive Example 11 |
| 2 | 12.1 | 5.1 | 3.0 | 3.1 | 1.8 | Comparative Example 1 |
| 2 | 12.8 | 11.2 | 4.2 | 6.0 | 2.5 | Comparative Example 2 |
| 5 | 21.5 | 12.1 | 2.1 | 6.8 | 1.6 | Comparative Example 3 |
| 6 | 13.6 | 10.7 | 1.8 | 6.4 | 1.5 | Comparative Example 4 |
| 2 | 11.9 | 0.0 | 0.0 | 0.0 | 0.0 | Conventional Example |

As shown in Table 1 to 3, in Inventive Examples 1 to 11, satisfying both the alloy composition and manufacturing conditions of the present disclosure, it can be confirmed that an average thickness of an internal oxide layer and/or a decarburized layer of a hot-rolled steel sheet, an average thickness of an internal oxide layer and/or a decarburized layer of a pickled steel sheet, a standard deviation of a thickness of an internal oxide layer and/or a decarburized layer in a length direction of the pickled steel sheet, an average thickness of an internal oxide layer and/or a decarburized layer of a cold-rolled steel sheet, and a standard deviation of a thickness of an internal oxide layer and/or a decarburized layer in a length direction of the cold-rolled steel sheet, all satisfy the required range.

On the other hand, in Comparative Examples 1 to 2, in which a pickling tank passing speed is uniformly controlled, the average thickness of the internal oxide layer and/or a decarburized layer of the pickled steel sheet and the cold-rolled steel sheet was evaluated to a desired level, but it can be seen that the standard deviation of the thickness of the internal oxide layer and/or a decarburized layer in the length direction of the pickled steel sheet and the cold-rolled steel sheet is excessively high, so that uniform surface quality may not be ensured.

In addition, in Comparative Example 3, it was shown that a content of carbon of the components of the hot-rolled coil was too high, so plate cracks occurred in a pickling process, and the average thickness of the internal oxide layer and decarburized layer of the hot-rolled steel sheet and the pickled steel sheet was large. In Conventional Example 4, which had an excessively high content of silicon, roughness increased as a large amount of red scale occurred on a surface thereof, and the average thickness of the internal oxide layer and/or a decarburized layer of the pickled steel sheet was large because a surface scale layer containing silicon did not sufficiently pickling.

Meanwhile, in Conventional Example, in which a pickling tank passing speed is constantly controlled at an excessively low speed, a case of an overpickling operation generally performed in a pickling treatment was shown, and it can be seen that the internal oxide layer/the decarburized layer of the pickled steel sheet or the cold-rolled steel sheet passing slowly through a pickling tank are entirely removed. However, in this conventional method, there is no problem of surface defects of a product as all of the internal oxide layer/the decarburized layer of the pickled steel sheet or cold-rolled steel sheet are removed, but there is a problem that the time of a pickling operation is very long, so there is a basic problem that it is inefficient and uneconomical.

Hereinafter, the present disclosure will be described in more detail through examples. However, it should be noted that the following examples are for illustrative purposes only and are not intended to limit the scope of the present disclosure. The scope of the present disclosure may be determined by matters described in the claims and matters able to be reasonably inferred therefrom.

While example embodiments have been shown and described above, it will be apparent to those skilled in the art that modifications and variations could be made without departing from the scope of the present disclosure as defined by the appended claims.

The invention claimed is:

1. A high-carbon pickled steel sheet having good surface quality, comprising, in weight %:

0.4% or more and less than 1.2% of carbon (C), 0.5% or less and excluding 0% of silicon (Si), 0.05% or less of phosphorus (P), 0.03% or less of sulfur(S), 0.1 to 2.5% in total of at least one of manganese (Mn) and chromium (Cr), and a balance of iron (Fe) and inevitable impurities, wherein an average thickness of an internal oxide layer and/or a decarburized layer formed in a surface layer portion of the steel sheet is 1 to 10 μm, and a standard deviation of the thickness of the internal oxide layer and/or the decarburized layer in a length direction of the steel sheet is 2 μm or less.

2. The high-carbon pickled steel sheet having good surface quality of claim 1, wherein the standard deviation of the thickness of the internal oxide layer and/or the decarburized layer in the length direction of the steel sheet is 1.6 μm or less.

3. A high-carbon cold-rolled steel sheet having good surface quality, comprising, in weight %:

0.4% or more and less than 1.2% of carbon (C), 0.5% or less and excluding 0% of silicon (Si), 0.02% or less of phosphorus (P), 0.01% or less of sulfur(S), 0.1 to 2.5% in total of at least one of manganese (Mn) and chromium (Cr), and a balance of iron (Fe) and inevitable impurities, wherein an average thickness of an internal oxide layer and/or a decarburized layer formed in a surface layer portion of the steel sheet is 1×[1−cold reduction ratio] μm to 10×[1−cold reduction ratio] μm, and a standard deviation of the thickness of the internal oxide layer and/or the decarburized layer in a length direction of the steel sheet is 2 μm or less.

4. The high-carbon cold-rolled steel sheet having good surface quality of claim 3, wherein the average thickness of the internal oxide layer and/or the decarburized layer formed in the surface layer portion of the steel sheet is in a range of 0.2 to 8 μm.

5. The high-carbon cold-rolled steel sheet having good surface quality of claim 3, wherein the standard deviation of the thickness of the internal oxide layer and/or the decarburized layer in the length direction of the steel sheet is 1.6 μm or less.

* * * * *